US005869997A

United States Patent [19]

Tomishima

[11] Patent Number: 5,869,997

[45] Date of Patent: Feb. 9, 1999

[54] INTERMEDIATE POTENTIAL GENERATING CIRCUIT

[75] Inventor: Shigeki Tomishima, Hyogo, Japan

[73] Assignee: Mitsubishi Denki Kabushiki Kaisha, Tokyo, Japan

[21] Appl. No.: 780,239

[22] Filed: Jan. 8, 1997

[30] Foreign Application Priority Data

Mar. 8, 1996 [JP] Japan ..... 8-051543

[51] Int. Cl.[6] ..... G05F 3/16; G05F 3/20

[52] U.S. Cl. ..... 327/543; 327/530; 327/539; 327/538; 323/313; 323/315; 365/226

[58] Field of Search ..... 327/333, 530, 327/534, 535, 540, 543, 544, 545, 546, 538, 539; 326/60, 62, 63, 80, 81; 365/226; 323/313, 312, 315

[56] References Cited

U.S. PATENT DOCUMENTS 5,361,000 11/1994 Koshikawa et al. ..... 327/541

*Primary Examiner*—Dinh Le

*Attorney, Agent, or Firm*—McDermott, Will & Emery

[57] ABSTRACT

In an intermediate potential generating circuit provided in a DRAM, a reference potential generating circuit includes two combinations of a resistor element constituted by a P channel MOS transistor and a diode constituted by an N channel MOS transistor, and outputs a reference potential Vcc/2+Vthn. A charging circuit constituted by an N channel MOS transistor charges an output node to an intermediate potential Vcc/2 based on the reference potential. A discharging circuit includes one combination of a resistor element constituted by a P channel MOS transistor and a diode constituted by an N channel MOS transistor, and provides a prescribed current flowing from the output node. Reduction of supply voltage Vcc becomes possible by eliminating a diode constituted by a P channel MOS transistor which makes reduction of a threshold voltage Vthp difficult.

4 Claims, 5 Drawing Sheets

INTERMEDIATE POTENTIAL GENERATING CIRCUIT

BACKGROUND OF THE INVENTION

1. Field of the Invention

The present invention relates to an intermediate potential generating circuit, and more particularly relates to an intermediate potential generating circuit for producing an intermediate potential which is between a first potential and a second potential lower than the first potential, and outputting it to an output terminal.

2. Description of the Background Art

A dynamic random access memory (hereinafter referred to as DRAM) is conventionally provided with an intermediate potential generating circuit for producing an intermediate potential Vcc/2 which is between a power supply potential Vcc and a ground potential GND. Intermediate potential Vcc/2 generated in the intermediate potential generating circuit is utilized as a precharge potential of a bit line and as a cell plate potential.

FIG. 3 is a circuit diagram showing a structure of a conventional intermediate potential generating circuit. With reference to FIG. 3, the intermediate potential generating circuit is provided with two reference potential generating circuits 31 and 36 and a drive circuit 41.

One reference potential generating circuit 31 includes a resistor element 32, N channel MOS transistors 33, 34 and a resistor element 35 that are serially connected between a line of power supply potential Vcc (hereinafter referred to as a power supply line) 20 and a line of ground potential GND (hereinafter referred to as a ground line) 21. Each of N channel MOS transistors 33 and 34 is diode-connected. Specifically, respective gates of N channel MOS transistors 33 and 34 are connected to their own drains. Resistor elements 32 and 35 have an equal resistance value and N channel MOS transistors 33 and 34 have an equal threshold voltage Vthn. Accordingly, an intermediate node N33 between N channel MOS transistors 33 and 34 is at intermediate potential Vcc/2, and an output node N32 between resistor element 32 and N channel MOS transistor 33 is at a first reference potential Vcc/2+Vthn.

The other reference potential generating circuit 36 includes a resistor element 37, P channel MOS transistors 38, 39 and a resistor element 40 that are serially connected between power supply line 20 and ground line 21. Respective gates of diode-connected P channel MOS transistors 38 and 39 are connected to their own drains. Resistor elements 37 and 40 have an equal resistance value and P channel MOS transistors 38 and 39 have an equal threshold voltage Vthp. Accordingly, an intermediate node N38 between P channel MOS transistors 38 and 39 is at intermediate potential Vcc/2, and an output node N39 between P channel MOS transistor 39 and resistor element 40 is at a second reference potential Vcc/2−Vthp.

Drive circuit 41 includes an N channel MOS transistor 42 and a P channel MOS transistor 43 connected in series between power supply line 20 and ground line 21. The gate of N channel MOS transistor 42 is connected to output node N32 of reference potential generating circuit 31 and the gate of P channel MOS transistor 43 is connected to output node N39 of reference potential generating circuit 36. A node N42 between MOS transistors 42 and 43 is an output node of the intermediate potential generating circuit.

An operation of this intermediate potential generating circuit will next be described. The output potential Vcc/2+Vthn of reference potential generating circuit 31 is supplied to the gate of N channel MOS transistor 42 of drive circuit 41, and the output potential Vcc/2−Vthp of reference potential generating circuit 36 is supplied to the gate of P channel MOS transistor 43 of drive circuit 41.

If a potential Vout of output node N42 is lower than intermediate potential Vcc/2, N channel MOS transistor 42 becomes conductive and output node N42 is charged. At this time, the potential of the gate of N channel MOS transistor 42 is Vcc/2+Vthn, so that output node N42 which is a source of N channel MOS transistor 42 is charged only to intermediate potential Vcc/2.

If potential Vout of output node N42 becomes higher than intermediate potential Vcc/2, P channel MOS transistor 43 becomes conductive and output node N42 is discharged. At this time, the potential of the gate of P channel MOS transistor 43 is Vcc/2−Vthp, so that output node N42 which is a source of P channel MOS transistor 43 is discharged only to intermediate potential Vcc/2. Therefore, potential Vout of output node N42 of the intermediate potential generating circuit is maintained at intermediate potential Vcc/2.

FIG. 4 is a circuit diagram showing a structure of another conventional intermediate potential generating circuit. Referring to FIG. 4, the intermediate potential generating circuit is provided with two reference potential generating circuits 51, 56 and a drive circuit 61.

One reference potential generating circuit 51 includes a P channel MOS transistor 52, an N channel MOS transistor 53, a P channel MOS transistor 54, and an N channel MOS transistor 55 connected in series between power supply line 20 and ground line 21. Each of N channel MOS transistors 53 and 55 is diode-connected. Respective gates of P channel MOS transistors 52 and 54 are connected to respective sources of N channel MOS transistors 53 and 55. Since gates of P channel MOS transistors 52 and 54 are respectively connected to nodes of low potential over N channel MOS transistors 53 and 55, each of P channel MOS transistors 52 and 54 operates as a resistor element. P channel MOS transistors 52 and 54 are identical in size, and N channel MOS transistors 53 and 55 have equal threshold voltage Vthn. Accordingly, an intermediate node N53 between N channel MOS transistor 53 and P channel MOS transistor 54 attains to intermediate potential Vcc/2, and an output node N52 between P channel MOS transistor 52 and N channel MOS transistor 53 attains to first reference potential Vcc/2+Vthn.

The other reference potential generating circuit 56 includes a P channel MOS transistor 57, an N channel MOS transistor 58, a P channel MOS transistor 59 and an N channel MOS transistor 60 connected in series between power supply line 20 and ground line 21. Each of P channel MOS transistors 57 and 59 is diode-connected. Respective gates of N channel MOS transistors 58 and 60 are connected to respective sources of P channel MOS transistors 57 and 59. The gates of N channel MOS transistors 58 and 60 are respectively connected to high potential nodes over P channel MOS transistors 57 and 59, so that each of N channel MOS transistors 58 and 60 operates as a resistor element. N channel MOS transistors 58 and 60 are identical in size, and P channel MOS transistors 57 and 59 have equal threshold voltage Vthp. Accordingly, an intermediate node N58 between N channel MOS transistor 58 and P channel MOS transistor 59 attains to intermediate potential Vcc/2, and an output node N59 between P channel MOS transistor 59 and N channel MOS transistor 60 attains to second reference potential Vcc/2−Vthp.

Drive circuit 61 is provided with an N channel MOS transistor 62 and a P channel MOS transistor 63 connected in series between power supply line 20 and ground line 21. The gate of N channel MOS transistor 62 is connected to output node N52 of reference potential generating circuit 51, and the gate of P channel MOS transistor 63 is connected to output node N59 of reference potential generating circuit 56. A node N62 between MOS transistors 62 and 63 is an output node of the intermediate potential generating circuit.

An operation of the intermediate potential generating circuit is described below. Output potential Vcc/2+Vthn of reference potential generating circuit 51 is supplied to the gate of N channel MOS transistor 62 of drive circuit 61, and output potential Vcc/2−Vthp of reference potential generating circuit 56 is supplied to the gate of P channel MOS transistor 63 of drive circuit 61.

If potential Vout of output node N62 becomes lower than intermediate potential Vcc/2, N channel MOS transistor 62 becomes conductive and output node N62 is charged up to intermediate potential Vcc/2. If potential Vout of output node N62 becomes higher than intermediate potential Vcc/2, P channel MOS transistor 63 becomes conductive and output node N62 is discharged up to intermediate potential Vcc/2. Accordingly, potential Vout of output node N62 of the intermediate potential generating circuit is maintained at intermediate potential Vcc/2.

FIG. 5 is a circuit diagram illustrating a structure of still another conventional intermediate potential generating circuit. With reference to FIG. 5, the intermediate potential generating circuit differs from that in FIG. 4 in that drive circuit 61 is substituted by a drive circuit 70.

Drive circuit 70 includes a P channel MOS transistor 71, an N channel MOS transistor 72, a P channel MOS transistor 73, and an N channel MOS transistor 74 connected in series between power supply line 20 and ground line 21, as well as a P channel MOS transistor 75 and an N channel MOS transistor 76 connected in series between power supply line 20 and ground line 21. The gate of N channel MOS transistor 72 is connected to output node N52 of reference potential generating circuit 51, and the gate of P channel MOS transistor 73 is connected to output node N59 of reference potential generating circuit 56. A node N72 between MOS transistors 72 and 73 is an output node of the intermediate potential generating circuit. Node N72 is connected to drains of MOS transistors 75 and 76.

Gates of P channel MOS transistors 71 and 75 are both connected to a drain of P channel MOS transistor 71, and P channel MOS transistors 71 and 75 thus constitute a current mirror circuit. Gates of N channel MOS transistors 74 and 76 are both connected to a drain of N channel MOS transistor 74, and N channel MOS transistors 74 and 76 thus constitute a current mirror circuit.

An operation of the intermediate potential generating circuit is next described. Output potential Vcc/2+Vthn of reference potential generating circuit 51 is supplied to the gate of N channel MOS transistor 72 in drive circuit 70, and output potential Vcc/2−Vthp of reference potential generating circuit 56 is supplied to the gate of P channel MOS transistor 73 in drive circuit 70.

If potential Vout of output node,N72 becomes lower than intermediate potential Vcc/2, N channel MOS transistor 72 becomes conductive and current is caused to flow from power supply line 20 to output node N72 through MOS transistors 71 and 72. At this time, since P channel MOS transistors 71 and 75 constitute the current mirror circuit, the electric current flowing from power supply line 20 through P channel MOS transistor 75 to output node N72 has a value corresponding to the value of the current flowing through P channel MOS transistor 71. Accordingly, potential Vout of output node N72 attains to intermediate potential Vcc/2 immediately.

On the other hand, if potential Vout of output node N72 becomes higher than intermediate potential Vcc/2, P channel MOS transistor 73 becomes conductive and electric current flows from output node N72 to ground line 21 through MOS transistors 73 and 74. At this time, N channel MOS transistors 74 and 76 constitute the current mirror circuit, so that the value of the electric current flowing from output node N72 through N channel MOS transistor 76 to ground line 21 has a value corresponding to that of the current flowing through N channel MOS transistor 74. Accordingly, potential Vout of output node N72 reaches intermediate potential Vcc/2 immediately. Potential Vout of output node N72 in the intermediate potential generating circuit is thus maintained at intermediate potential Vcc/2.

FIG. 6 is a circuit diagram showing a structure of a further conventional intermediate potential generating circuit. With reference to FIG. 6, the intermediate potential generating circuit differs from that shown in FIG. 3 in that reference potential generating circuit 36 is eliminated and drive circuit 41 is substituted by a drive circuit 81.

Drive circuit 81 is provided with two N channel MOS transistors 82 and 83 connected in series between power supply line 20 and ground line 21. The gate of N channel MOS transistor 82 is connected to output node N32 of reference potential generating circuit 31, and the gate of N channel MOS transistor 83 is connected to power supply line 20. A node N82 between N channel MOS transistors 82 and 83 is an output node of the intermediate potential generating circuit.

Next, an operation of the intermediate potential generating circuit is described. Output potential Vcc/2+Vthn of reference potential generating circuit 31 is supplied to the gate of N channel MOS transistor 82 in drive circuit 81. If potential Vout of output node N82 becomes lower than intermediate potential Vcc/2, N channel MOS transistor 82 becomes conductive and a charging current I82 flows from power supply line 20 to output node N82 through N channel MOS transistor 82. At this time, since the potential of the gate of N channel MOS transistor 82 is Vcc/2+Vthn, output node N82 which is a source of N channel MOS transistor 82 is charged only to intermediate potential Vcc/2.

In the meantime, since a discharging current I83 constantly flows from output node N82 through N channel MOS transistor 83 to ground line 21, potential Vout of output node N82 tends to decrease. Potential Vout of output node N82 is kept at intermediate potential Vcc/2, as discharging current I83 and charging current I82 are balanced.

However, the intermediate potential generating circuits shown in FIGS. 3 to 5 do not operate normally unless requirements of Vcc>2 Vthn+2RI and Vcc>2 Vthp+2RI are met (where R represents a resistance value of the resistor element in the reference potential generating circuit, and I represents a current value flowing in the reference potential generating circuit), since they are provided with reference potential generating circuits 31, 51 including diode-connected N channel MOS transistors 33, 34; 53, 55 as well as reference potential generating circuits 36, 56 including diode-connected P channel MOS transistors 38, 39; 57, 59.

On the other hand, supply voltage Vcc in a DRAM has been reduced in recent years, and threshold voltage Vthn and Vthp of the MOS transistors must be reduced in order to meet the requirements described above.

However, breakdown voltage characteristic is worse in the P channel MOS transistor compared to the N channel MOS transistor in the process technique now available, so that threshold voltage Vthp of the P channel MOS transistor cannot be reduced to the level corresponding to threshold voltage Vthn of the N channel MOS transistor. For this reason, the lowest value of supply voltage Vcc is determined by threshold voltage Vthp of the P channel MOS transistor in the intermediate potential generating circuits shown in FIGS. 3 to 5.

As for the intermediate potential generating circuit in FIG. 6, it is provided with only reference potential generating circuit 31 including diode-connected N channel MOS transistors 33 and 34. Therefore, it is sufficient to meet the requirement Vcc>2 Vthn+2RI only. Therefore, reduction of supply voltage Vcc becomes possible, different from the intermediate potential generating circuits in FIGS. 3 to 5 in which the lowest value of supply voltage Vcc is determined by Vthp higher than Vthn.

However, the balance between charging current I82 and constantly flowing discharging current I83 cannot easily be maintained. In order to strike the balance, a circuit should be designed considering various factors such as supply voltage Vcc, temperature, and device property, and the circuit design becomes difficult.

SUMMARY OF THE INVENTION

An object of the present invention is to provide an intermediate potential generating circuit which realizes a stable operation even at a low supply voltage and which can be easily designed.

An intermediate potential generating circuit according to the present invention generates an intermediate potential between a first potential and a second potential lower than the first potential and outputs the intermediate potential to an output terminal. The intermediate potential generating circuit is provided with a reference potential generating circuit, a charging circuit, and a discharging circuit. The reference potential generating circuit includes a first resistor element, a first diode element, a second resistor element, and a second diode element connected in series between a first potential line and a second potential line. The reference potential generating circuit outputs a reference potential which is higher than the intermediate potential by a threshold voltage of the first diode element from an output node between the first resistor element and the first diode element. The charging circuit includes a first transistor having a first electrode receiving the first potential, a second electrode connected to an output terminal, and an input electrode connected to the output node of the reference potential generating circuit, and charges the output terminal to the intermediate potential. The discharging circuit includes a third resistor element and a third diode element connected in series between the first potential line and the second potential line, and causes a prescribed discharging current to flow out from the output terminal to the second potential line.

In the intermediate potential generating circuit, one reference potential generating circuit produces one reference potential, the charging circuit then charges the output terminal to the intermediate potential based on the reference potential, and the discharging circuit causes a prescribed discharging current to flow from the output terminal. The output terminal can be maintained at the intermediate potential by balancing the charging current and the discharging current. Since there is only one reference potential generating circuit, supply voltage can be reduced by providing a diode element constituted by an N channel MOS transistor for the reference potential generating circuit. Layout area can be reduced compared with the conventional circuit provided with two reference potential generating circuits, since only one reference potential generating circuit is provided. The structure between the node of intermediate potential and the second potential line in the reference potential generating circuit is identical to the structure between the output node and the second potential line in the discharging circuit, so that the output node can be maintained at the intermediate potential by applying equal current to both circuits, and the circuit can be designed more easily.

Preferably, the first transistor of the charging circuit is of a first conductivity type, and the first resistor element, the first diode element, the second resistor element, and the second diode element of the reference potential generating circuit are respectively constituted by a second transistor of a second conductivity type, a third transistor of the first conductivity type, a fourth transistor of the second conductivity type, and a fifth transistor of the first conductivity type. Respective input electrodes of the third and the fifth transistors are connected to their own first electrodes, and input electrodes of the second and the fourth transistors are respectively connected to second electrodes of the third and the fifth transistors. The reference potential generating circuit can thus be constituted easily.

Preferably, the third resistor element and the third diode element of the discharging circuit are respectively constituted by a sixth transistor of the second conductivity type and a seventh transistor of the first conductivity type connected in series between the output terminal and the second potential line. An input electrode of the seventh transistor is connected to its first electrode, and an input electrode of the sixth transistor is connected to a second electrode of the seventh transistor. The discharging circuit can thus be constituted easily.

Preferably, the charging circuit further includes an eighth transistor of the second conductivity type having an input electrode and a first electrode connected to the first electrode of the first transistor and a second electrode connected to the first potential line, as well as a ninth transistor of the second conductivity type connected between the first potential line and the output terminal and having an input electrode connected to the input electrode of the eighth transistor. The eighth and ninth transistors constitute a current mirror circuit for causing a current flow M times higher than a current flowing in the eighth transistor from the first potential line to the output terminal. In this case, even if the output potential becomes lower than the intermediate potential, the output potential can be returned to the intermediate potential immediately, since a high charging current can be provided owing to the current amplification function of the current mirror circuit.

Preferably, the discharging circuit further includes a tenth transistor of the first conductivity type connected between the output terminal and the second potential line, and having an input electrode connected to the input electrode of the seventh transistor. The seventh and the tenth transistors constitute a current mirror circuit for providing a current N times higher than a current flowing in the seventh transistor from the output terminal to the second potential line. In this case, even if the output potential becomes higher than the intermediate potential, the output potential can be returned to the intermediate potential immediately by providing a higher discharging current owing to the current amplification function of the current mirror circuit.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[First Embodiment]

Figure 1:
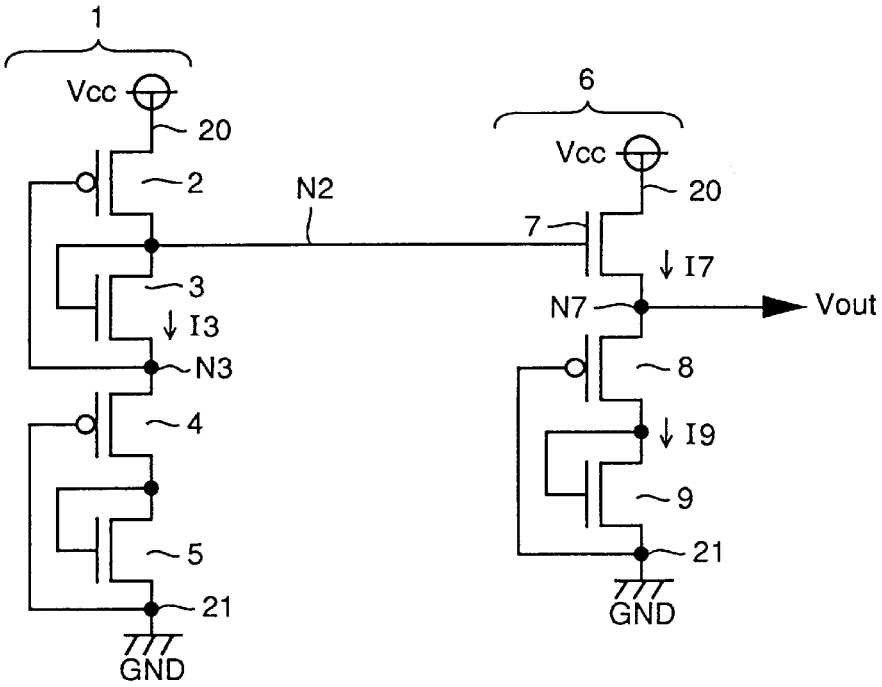
FIG. 1 is a circuit diagram showing a structure of an intermediate potential generating circuit according to the first embodiment of the present invention.

With reference to FIG. 1, the intermediate potential generating circuit is provided with one reference potential generating circuit 1 and a drive circuit 6.

Reference potential generating circuit 1 includes a P channel MOS transistor 2, an N channel MOS transistor 3, a P channel MOS transistor 4, and an N channel MOS transistor 5 connected in series between power supply line 20 and ground line 21. Each of N channel MOS transistors 3 and 5 is diode-connected. In other words, the gate of N channel MOS transistor 3 is connected to its drain, and the gate of N channel MOS transistor 5 is connected to its drain. Gates of P channel MOS transistors 2 and 4 are respectively connected to sources of N channel MOS transistors 3 and 5. Since the gates of P channel MOS transistors 2 and 4 are respectively connected to nodes of low potential over N channel MOS transistors 3 and 5, each of P channel MOS transistors 2 and 4 operates as a resistor element. P channel MOS transistors 2 and 4 are identical in size, and N channel MOS transistors 3 and 5 have an identical size and an equal threshold voltage Vthn. Accordingly, an intermediate node N3 between N channel MOS transistor 3 and P channel MOS transistor 4 attains to intermediate potential Vcc/2, and an output node N2 between P channel MOS transistor 2 and N channel MOS transistor 3 attains to reference potential Vcc/2+Vthn.

Drive circuit 6 includes an N channel MOS transistor 7, a P channel MOS transistor 8 and an N channel MOS transistor 9 connected in series between power supply line 20 and ground line 21. N channel MOS transistors 7 and 9 and N channel MOS transistors 3 and 5 in reference potential generating circuit 1 are identical in size and have equal threshold voltage Vthn, and P channel MOS transistor 8 and P channel transistors 2 and 4 in reference potential generating circuit 1 are identical in size.

A gate of N channel MOS transistor 7 is connected to output node N2 of reference potential generating circuit 1. N channel MOS transistor 9 is diode-connected. In other words, a gate of N channel MOS transistor 9 is connected to its drain. A gate of P channel MOS transistor 8 is connected to ground line 21. Since the gate of P channel MOS transistor 8 is connected to a node of low potential over N channel MOS transistor 9, P channel MOS transistor 8 operates as a resistor element. A node N7 between MOS transistors 7 and 8 is an output node of the intermediate potential generating circuit.

An operation of the intermediate potential generating circuit is next described. Output potential Vcc/2+Vthn of reference potential generating circuit 1 is supplied to the gate of N channel MOS transistor 7 in drive circuit 6. If potential Vout of output node N7 becomes lower than intermediate potential Vcc/2, N channel MOS transistor 7 becomes conductive and a charging current I7 flows into output node N7 from power supply line 20 through N channel MOS transistor 7. At this time, since the gate of N channel MOS transistor 7 has a potential of Vcc/2+Vthn, output node N7 which is a source of N channel MOS transistor 7 is charged up to only intermediate potential Vcc/2. Accordingly, when output node N7 becomes intermediate potential Vcc/2, N channel MOS transistor 7 becomes non-conductive, and the flow of charging current I7 into output node N7 is stopped.

Meanwhile, a discharging current I9 flows out from output node N7 through MOS transistors 8 and 9 to ground line 21, and potential Vout of output node N7 tends to decrease. Potential Vout of output node N7 can be maintained at intermediate potential Vcc/2 by balancing discharging current I9 and charging current I7.

At this time, since N channel MOS transistors 3 and 7 are identical in size and respective gates are connected to each other, a current I3 flowing in N channel MOS transistor 3 and current I7 flowing in N channel MOS transistor 7 are equal. The structure between intermediate node N3 and ground line 21 in reference potential generating circuit 1 (MOS transistors 4, 5) and the structure between output node N7 and ground line 21 (MOS transistors 8, 9) are identical. Therefore, potential Vout of output node N7 is normally equal to potential Vcc/2 of the intermediate node of reference potential generating circuit 1.

If potential Vout of output node N7 becomes higher than intermediate potential Vcc/2, each resistance value of MOS transistors 8 and 9 decreases by the difference between potential Vout and intermediate potential Vcc/2, so that discharging current I9 increases and output potential Vout immediately returns to intermediate potential Vcc/2.

In the intermediate potential generating circuit according to this embodiment, only reference potential generating circuit 1 including a resistor element constituted by a P channel MOS transistor and a diode constituted by an N channel MOS transistor is provided and there is no reference potential generating circuit including a diode constituted by a P channel MOS transistor, so that threshold voltage Vthp of the P channel MOS transistor does not affect an operating condition, and only threshold Vthn of the N channel MOS transistor is related to the operating condition. More specifically, among the requirements described above, only the requirement of Vcc>2 Vthn+2RI should be met and it is not necessary to meet the requirement of Vcc>2 Vthp+2RI. Therefore, reduction of supply voltage Vcc becomes possible, different from the conventional circuit in which the lowest value of supply voltage Vcc is determined by Vthp higher than Vthn.

Compared with the conventional circuit provided with two reference potential generating circuits, the circuit of this embodiment provided with only one reference potential generating circuit can have reduced layout area.

Since the structure between intermediate node N3 and ground line 21 in reference potential generating circuit 1 and the structure between output node N7 and ground line 21 are identical, output node N7 can thus be maintained at intermediate potential Vcc/2 if an equal amount of current is provided in both structures, and the circuit can be designed more easily.

[Second Embodiment]

Figure 2:
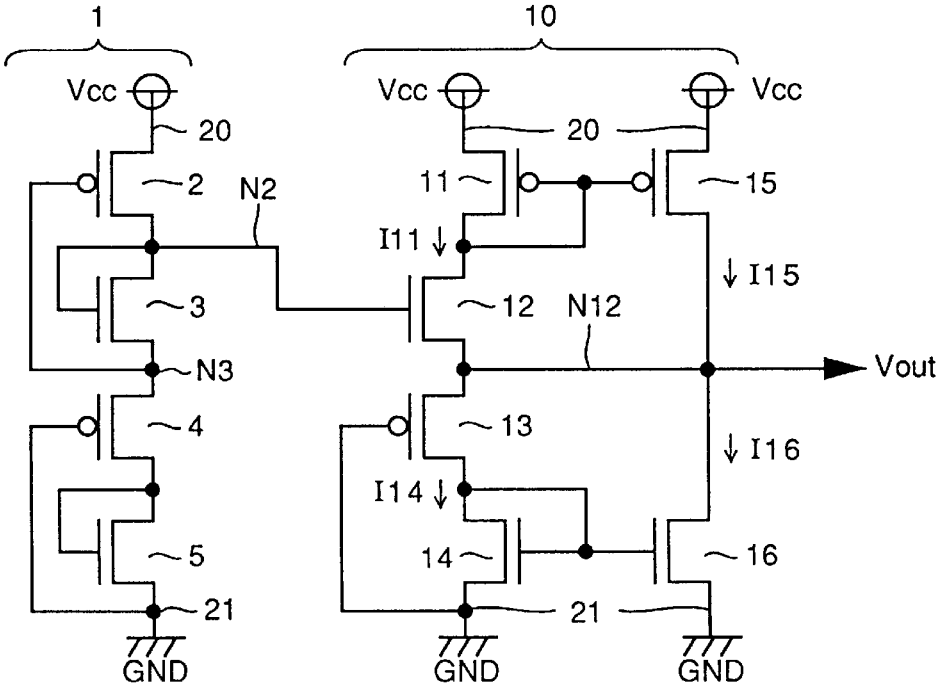
FIG. 2 is a circuit diagram showing a structure of an intermediate potential generating circuit according to the second embodiment of the invention.
Figure 3:
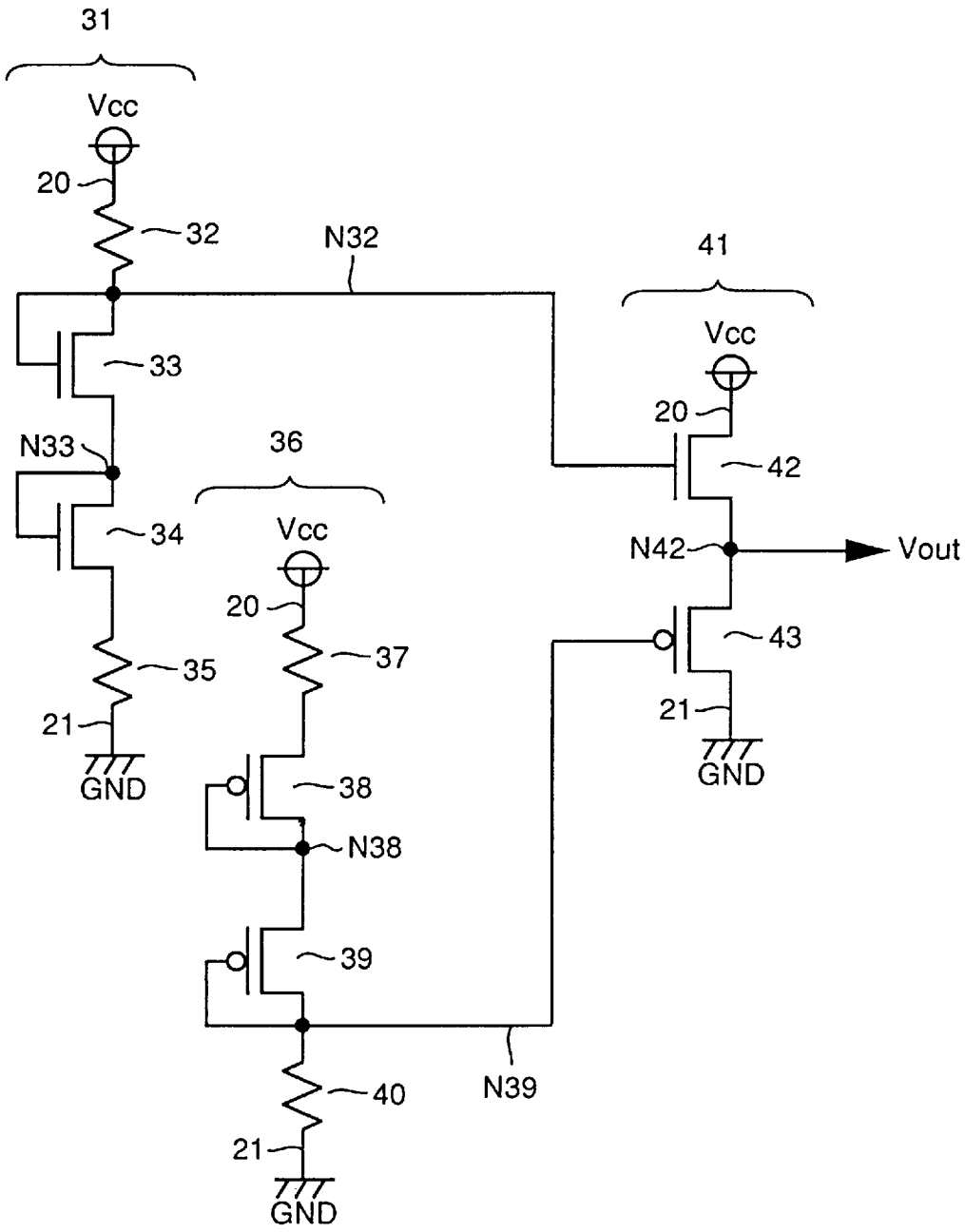
FIG. 3 PRIOR ART
FIG. 3 is a circuit diagram illustrating a structure of a conventional intermediate potential generating circuit.
Figure 4:
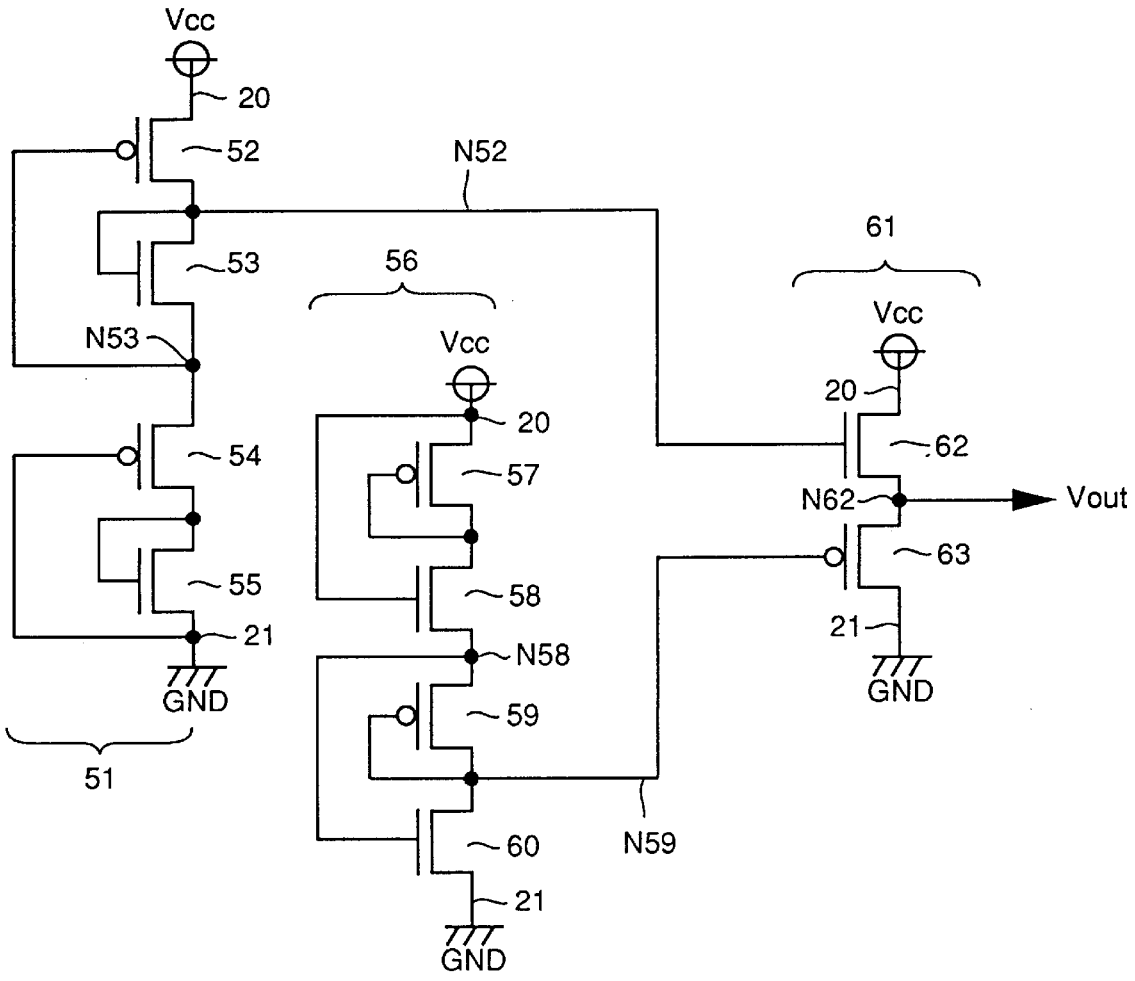
FIG. 4 PRIOR ART
FIG. 4 is a circuit diagram illustrating a structure of another conventional intermediate potential generating circuit.
Figure 5:
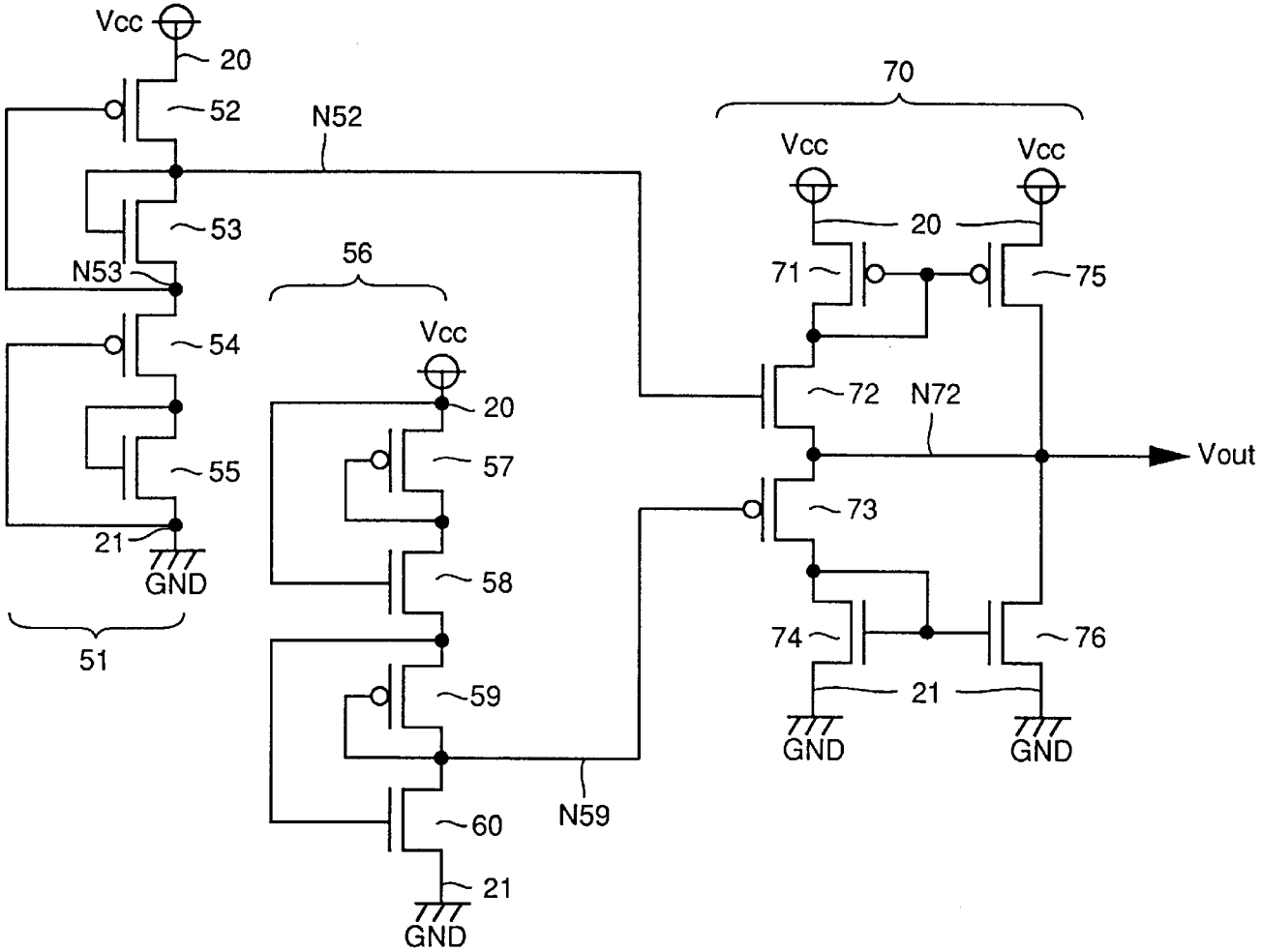
FIG. 5 PRIOR ART
FIG. 5 is a circuit diagram showing a structure of still another conventional intermediate potential generating circuit.
Figure 6:
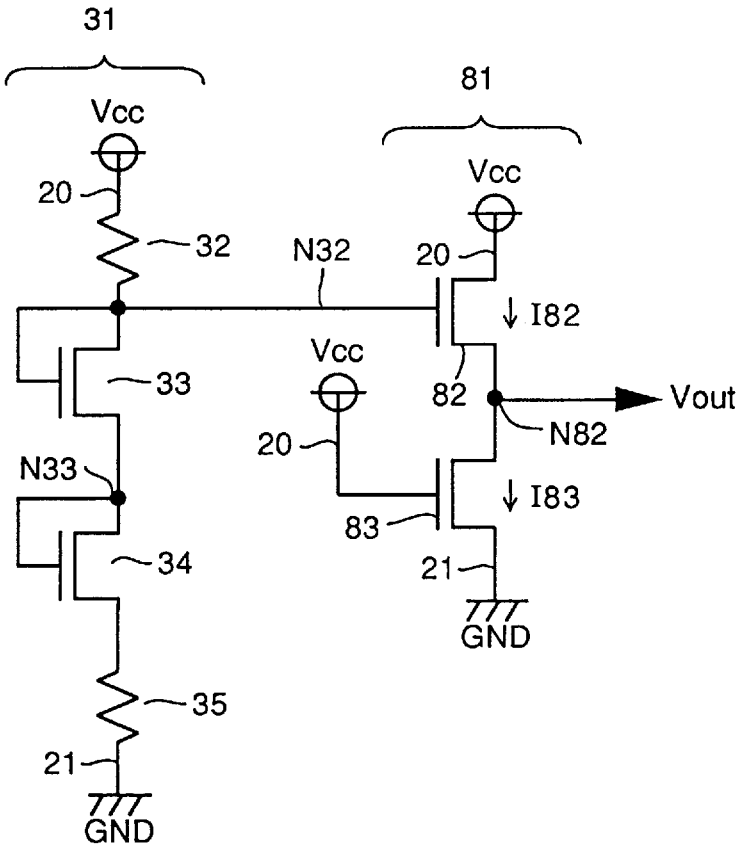
FIG. 6 PRIOR ART
FIG. 6 is a circuit diagram showing a structure of a further conventional intermediate potential generating circuit.

With reference to FIG. 2, the intermediate potential generating circuit differs from that shown in FIG. 1 in that drive circuit 6 is substituted by a drive circuit 10.

Drive circuit 10 includes a P channel MOS transistor 11, an N channel MOS transistor 12, a P channel MOS transistor 13, and an N channel MOS transistor 14 connected in series between power supply line 20 and ground line 21 as well as a P channel MOS transistor 15 and an N channel MOS transistor 16 connected in series between power supply line 20 and ground line 21. The gate of N channel MOS transistor 12 is connected to output node N2 of reference potential generating circuit 1, and the gate of P channel MOS transistor 13 is connected to ground line 21. Since the gate of P channel MOS transistor 13 is connected to a node of low potential over an N channel MOS transistor 14, P channel MOS transistor 13 operates as a resistor element. A node N12 between MOS transistors 12 and 13 is an output node of this intermediate potential generating circuit. Node N12 is connected to drains of MOS transistors 15 and 16.

Gates of P channel MOS transistors 11 and 15 are both connected to a drain of P channel MOS transistor 11, and P channel MOS transistors 11 and 15 thus constitute a current mirror circuit. Gates of N channel MOS transistors 14 and 16 are both connected to a drain of N channel MOS transistor 14, and n channel MOS transistors 14 and 16 constitute a current mirror circuit.

An operation of the intermediate potential generating circuit is next described. Output potential Vcc/2+Vthn of reference potential generating circuit 1 is supplied to the gate of N channel MOS transistor 12 of drive circuit 10.

If potential Vout of output node N12 becomes lower than intermediate potential Vcc/2, N channel MOS transistor 12 becomes conductive and a charging current I11 flows into output node N12 from power supply line 20 through MOS transistors 11 and 12. At this time, since P channel MOS transistors 11 and 15 constitute the current mirror circuit, a current I15 which is M times larger than a current I11 flowing in P channel MOS transistor 11 is supplied from power supply line 20 through P channel MOS transistor 15 into output node N12 (M is a current amplification rate of the current mirror circuit constituted by P channel MOS transistors 11 and 15 and is a positive real number). Accordingly, potential Vout of output node N12 immediately becomes potential Vcc/2.

In the meantime, a discharging current I14 flows from output node N12 through MOS transistors 13 and 14 to ground line 21, and a current I16 which is N times larger than discharging current I14 flows out from output node N12 through N channel MOS transistor 16 to ground line 21 (N is a current amplification rate of the current mirror circuit constituted by P channel MOS transistors 14 and 16 and is a positive real number). Therefore, potential Vout of output node N12 tends to decrease. Potential Vout of output node N12 can be maintained at intermediate potential Vcc/2 by balancing discharging currents I14 and I16 and charging currents I11 and I15.

If potential Vout of output node N12 becomes higher than intermediate potential Vcc/2, each resistance value of MOS transistors 13, 14 and 16 decreases by the difference between Vout of output node N12 and intermediate potential Vcc/2, so that-discharging current I14 and I16 increase and output potential Vout immediately becomes intermediate potential Vcc/2. Accordingly, output potential Vout is maintained at intermediate potential Vcc/2.

In the intermediate potential generating circuit according to this embodiment, the same effect as that of the first embodiment can be obtained, and larger charging/discharging current flows compared with the first embodiment, so that output potential Vout is corrected to Vcc/2 immediately even if output potential Vout deviates from intermediate potential Vcc/2, and output potential Vout is accordingly stabilized.

If reduction of threshold voltage Vthp of P channel MOS transistor is more easily realized than reduction of threshold voltage Vthn of N channel MOS transistor owing to the improvement of the process technique, similar effect can be obtained by reversing the conductivity type of the MOS transistors and exchanging power supply line 20 and ground line 21 in FIGS. 1 and 2.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An intermediate potential generating circuit producing an intermediate potential between a first potential and a second potential lower than the first potential and outputting it to an output terminal, comprising:

reference potential generating means including first resistor means, first diode means, second resistor means, and second diode means connected in series between said first potential and said second potential, for outputting a reference potential higher than said intermediate potential by a threshold voltage of said first diode means from an output node between said first resistor means and said first diode means;

charging means including a first transistor having a first electrode receiving said first potential, a second electrode connected to said output terminal, and a control electrode connected to the output node of said reference potential generating means, for charging said output terminal to said intermediate potential; and discharging means including third resistor means and third diode means connected in series between said output terminal and said second potential, for causing a predetermined discharging current to flow from said output terminal to said second potential, wherein said third diode means and said third resistor means of said discharging means are respectively a second transistor of a first conductivity type and a third transistor of a second conductivity type connected in series between said second potential and said output terminal, and a control electrode of said second transistor is connected to a first electrode of said second transistor and a control electrode of said third transistor is connected to a second electrode of said second transistor.

2. The intermediate potential generating circuit according to claim 1, wherein said first transistor of said charging means is of the first conductivity type, said first resistor means, said first diode means, said second resistor means and said second diode means of said reference potential generating means are respectively a fourth transistor of the second conductivity type, a fifth transistor of the first conductivity type, a sixth transistor of the second conductivity type, and a seventh transistor of the first conductivity type, and control electrodes of said fifth and seventh transistors are connected respectively to first electrodes of said fifth and seventh transistors, and control electrodes of said fourth and sixth transistors are connected respectively to second electrodes of said fifth and seventh transistors.

3. The intermediate potential generating circuit according to claim 2, wherein said charging means further includes an eighth transistor of the second conductivity type having a control electrode and a first electrode connected to the first electrode of said first transistor and having a second electrode connected to said first potential, and a ninth transistor of the second conductivity type connected between said first potential and said output terminal and having a control electrode connected to the control electrode of said eighth transistor, said eighth and ninth transistors constitute a current mirror circuit for generating a first current which is M (M is a positive real number) times higher than a second current flowing in said eighth transistor to flow from said first potential to said output terminal through said ninth transistor.

4. The intermediate potential generating circuit according to claim 3, wherein said discharging means further includes a tenth transistor of the first conductivity type connected between said output terminal and said second potential and having a control electrode connected to the control electrode of said second transistor, said second and tenth transistors constitute a current mirror circuit for generating a third current which is N (N is a positive real number) times higher than a current flowing in said second transistor to flow from said output terminal to said second potential through said tenth transistor.

* * * * *